US009480297B2

(12) United States Patent
Kim

(10) Patent No.: US 9,480,297 B2
(45) Date of Patent: Nov. 1, 2016

(54) VENTILATING FOOTPAD

(71) Applicant: Nahyun Kim, Forest Hills, NY (US)

(72) Inventor: Nahyun Kim, Forest Hills, NY (US)

( * ) Notice: Subject to any disclaimer, the term of this patent is extended or adjusted under 35 U.S.C. 154(b) by 0 days.

(21) Appl. No.: 14/481,919

(22) Filed: Sep. 10, 2014

(65) Prior Publication Data

US 2016/0066646 A1 Mar. 10, 2016

(51) Int. Cl.
*A43B 7/08* (2006.01)
*A43B 13/14* (2006.01)

(52) U.S. Cl.
CPC ..... *A43B 7/088* (2013.01); *A43B 7/087* (2013.01); *A43B 13/14* (2013.01)

(58) Field of Classification Search
CPC ..... A43B 7/088; A43B 7/087; A43B 7/06; A43B 7/08; A43B 7/10; A43B 7/081; A43B 7/082; A43B 7/084; A43B 13/14; A43B 17/08; A43B 7/146; A43B 17/00
USPC ..... 36/43, 141, 25 R, 147, 3 B, 3 R
See application file for complete search history.

(56) References Cited

U.S. PATENT DOCUMENTS

| | | | | |
|---|---|---|---|---|
| 3,180,039 | A | 4/1965 | Burns | |
| 4,602,441 | A | 7/1986 | El Sakkaf | |
| 5,035,068 | A | 7/1991 | Biasi | |
| 5,400,526 | A | 3/1995 | Sessa | |
| 6,305,100 | B1 | 10/2001 | Komamycky | |
| 6,874,252 | B2 | 4/2005 | Nakano | |
| 2009/0056171 | A1* | 3/2009 | Lin | A43B 7/146 36/3 B |
| 2011/0162240 | A1* | 7/2011 | Pieri | A43B 7/082 36/3 B |

* cited by examiner

*Primary Examiner* — Anna Kinsaul
*Assistant Examiner* — Heather Mangine
(74) *Attorney, Agent, or Firm* — Rabin & Berdo, P.C.

(57) ABSTRACT

The footpad of the present invention has multiple holes through which air flows to ventilate a wearer's feet while the wearer walks, runs, or jumps. The present invention provides sufficient support to the wearer and traction control to be used as the sole in a shoe or sandal. The present invention has a belt that slides to open or restrict the multiple holes through which air flows to ventilate the feet. Thus, for example, the wearer can open the holes for ventilation during warm weather and close the holes to restrict ventilation during cold weather.

15 Claims, 6 Drawing Sheets

VENTILATING FOOTPAD

BACKGROUND OF INVENTION

1. Field of Invention

The present invention concerns a ventilated footpad or shoe sole that promotes air flow to the feet for ventilation.

2. Description of Prior Art

Footwear has traditionally been designed to protect the wearer's feet from heat, cold, and trauma. The modern consumer expects to take long walks without suffering foot fatigue or irritation. Another important function of modern footwear is to provide cushion support so that the wearer can walk, run, and jump with minimal impact upon joints and vertebrae. However, despite having all these needs met, the modern consumer is still unsatisfied with the lack of ventilation to the feet that is prevalent in modern footwear.

The skin of the human foot exudes perspiration, as well as odors, in varying degrees, depending upon such factors as temperature of the ambient, the amount of physical activity being performed, and the natural propensity of the particular person to perspire. The comfort and health of the human foot is greatly influenced by the rate of evaporation of the perspiration generated as a result of movement and/or physical exercise. Thus, the restrictive nature of the modern footwear promotes offensive foot odor due to lack of ventilation. This problem has been acknowledged by footwear designers and has been addressed with varying degrees of failure in many different ways over the past decades.

One way of providing more ventilation to the feet is with soles and footpads that employ various interconnected pumping chambers, bladders, valves, jets, tubes, orifices, and the like. Patents exemplifying this approach include U.S. Pat. Nos. 3,180,039; 3,225,463; 4,215,492; 4,499,672; 4,654,982; 4,760,651; 4,776,109; 4,860,463; 5,010,661; 5,224,277; 5,282,324; 5,341,581; 5,606,806; 5,787,609; 5,809,665; 5,815,949; 5,813,141; and 5,826,349. These patents, for the most part, teach products that use the motion of the feet while walking to agitate or exchange air surrounding the foot.

Another approach attempted several times is to use compressible supporting structures situated in a space defined between the upper and lower layers of a footpad or insole. Patents teaching this approach include U.S. Pat. Nos. 3,716,930; 4,223,455; 4,364,186; 4,590,689; 4,674,203; 4,9110,882; 5,035,068; 5,619,809; 5,669,161; 5,675,914; and 5,845,418.

A third approach involves the use of ribs, heads, liquid cells, knobs, or nipples to ventilate. Patents that teach this approach include U.S. Pat. Nos. 4,685,224; 4,831,749; 5,167,999; 5,607,749; and 5,694,705.

Despite the vast number of approaches, the need persists for improved soles and footpads which deliver proper ventilation to the feet while providing support for walking, shock absorption, and comfortable static support. In this regard, the present invention substantially fulfills this need.

SUMMARY OF THE INVENTION

Accordingly, the present invention has been made in view of the above-mentioned disadvantages occurring in the prior art. The present invention is a footpad that maximizes the air flow to the feet of the wearer.

It is therefore a primary object of the present invention to provide adequate ventilation and reduce perspiration of the wearer's feet.

Another object of the present invention is to provide a footpad that is structurally adequate to support the weight of the wearer such that it may be used as the sole of a shoe or sandal.

Yet another object of the present invention to provide a footpad that promotes adequate traction with the floor so that the wearer does not slip and fall.

The above objects and other features and advantages of the present invention, as well as the structure and operation of various embodiments of the present invention, are described in detail below with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Reference will now be made to the drawings in which various elements of the present invention will be given numerical designations and in which the invention will be discussed so as to enable one skilled in the art and make use the invention.

Figure 1:
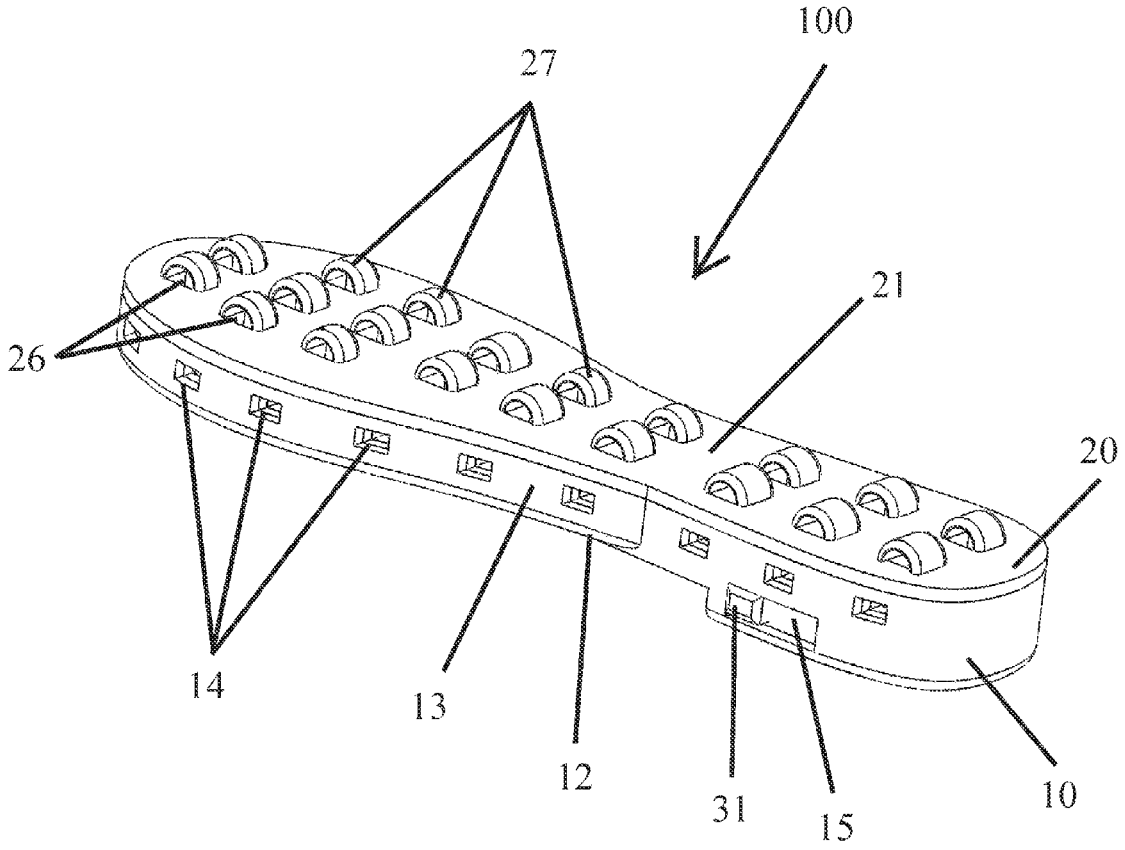
FIG. 1 is a perspective view of the footpad of the present invention.
Figure 2:
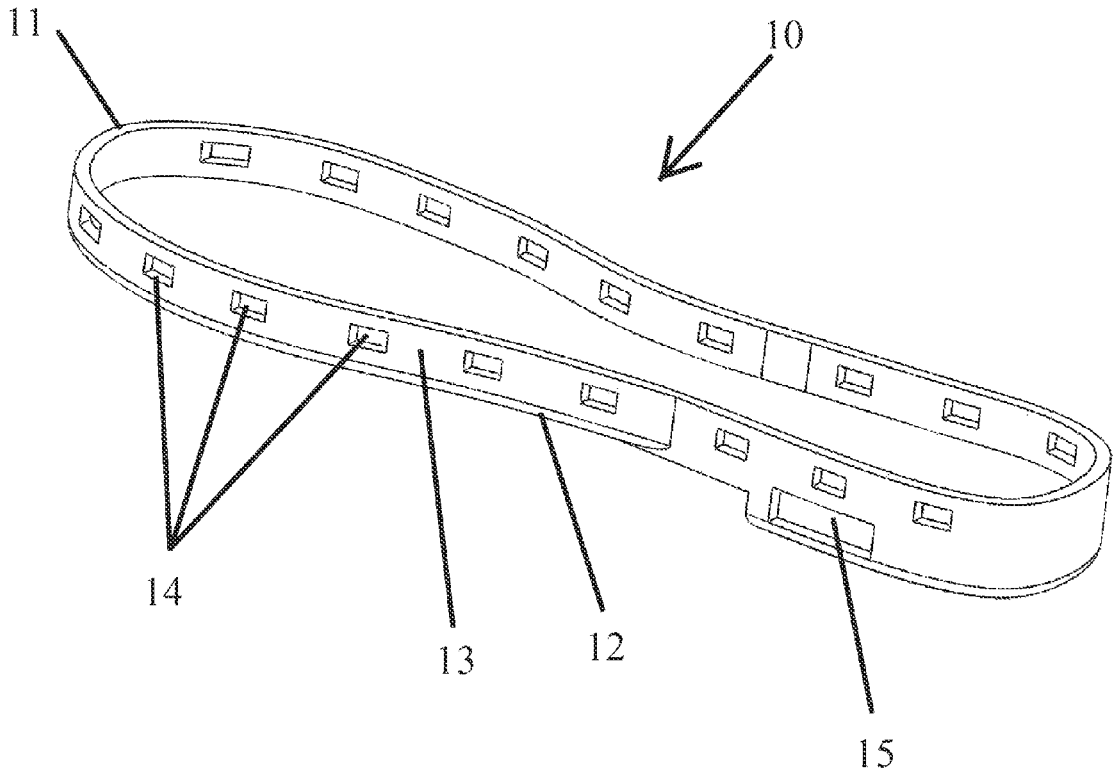
FIG. 2 are perspective views of the bottom pad of the present invention.
Figure 3:
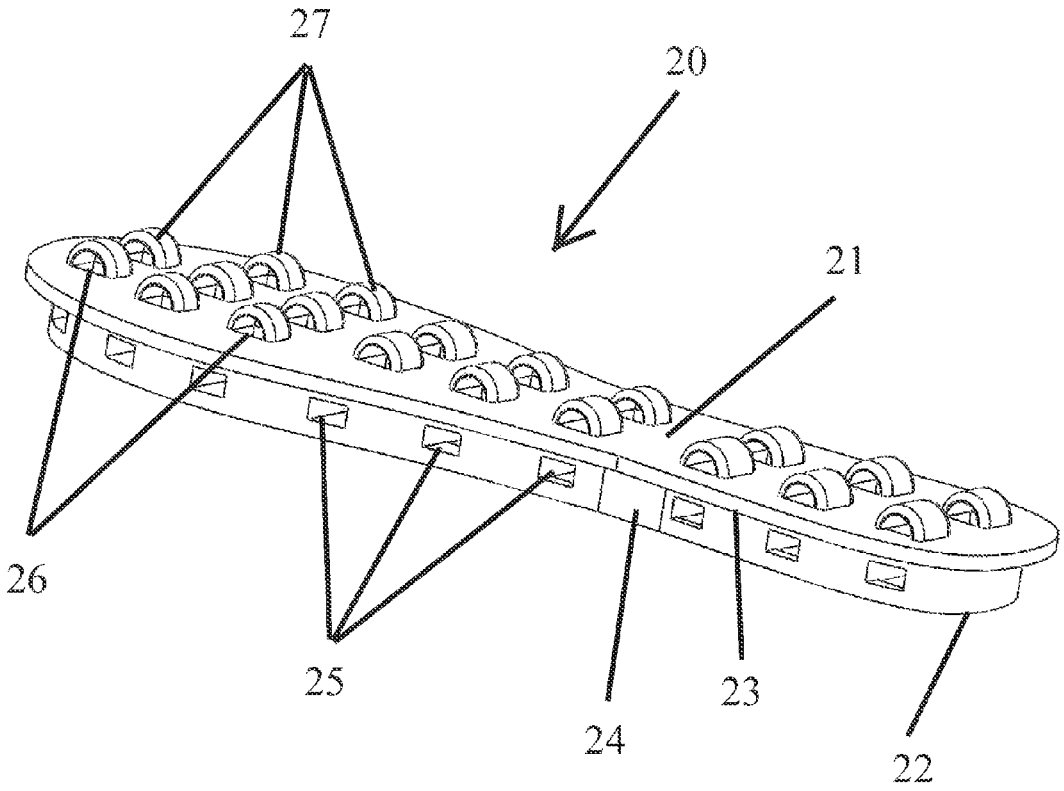
FIG. 3 are perspective views of the top pad of the present invention.
Figure 4:
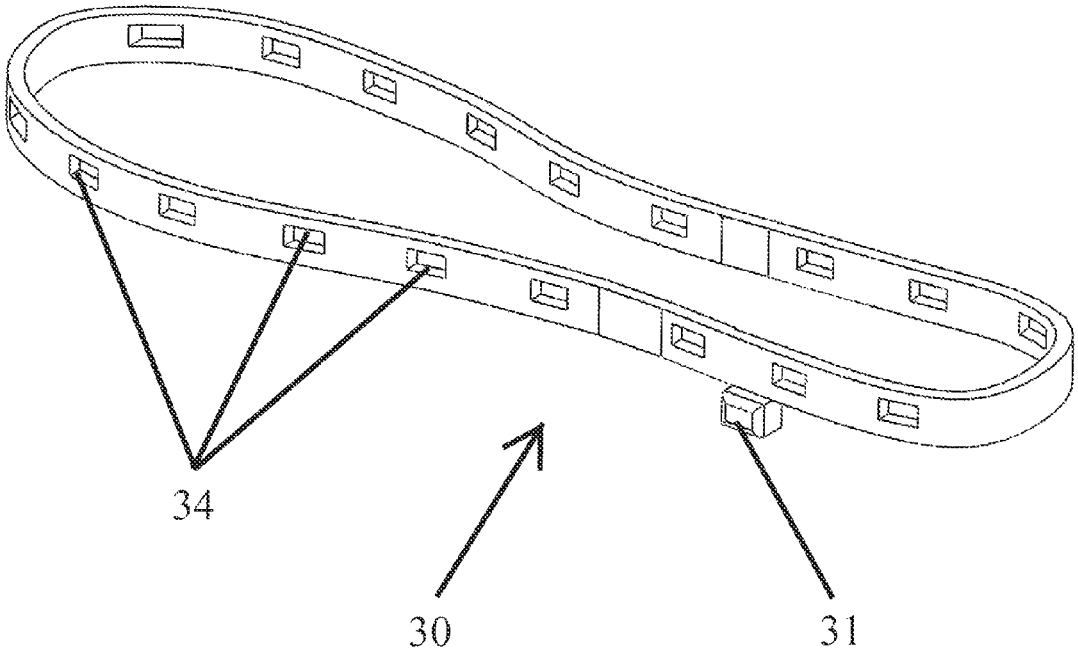
FIG. 4 is a perspective view of the belt of the present invention.
Figure 5:
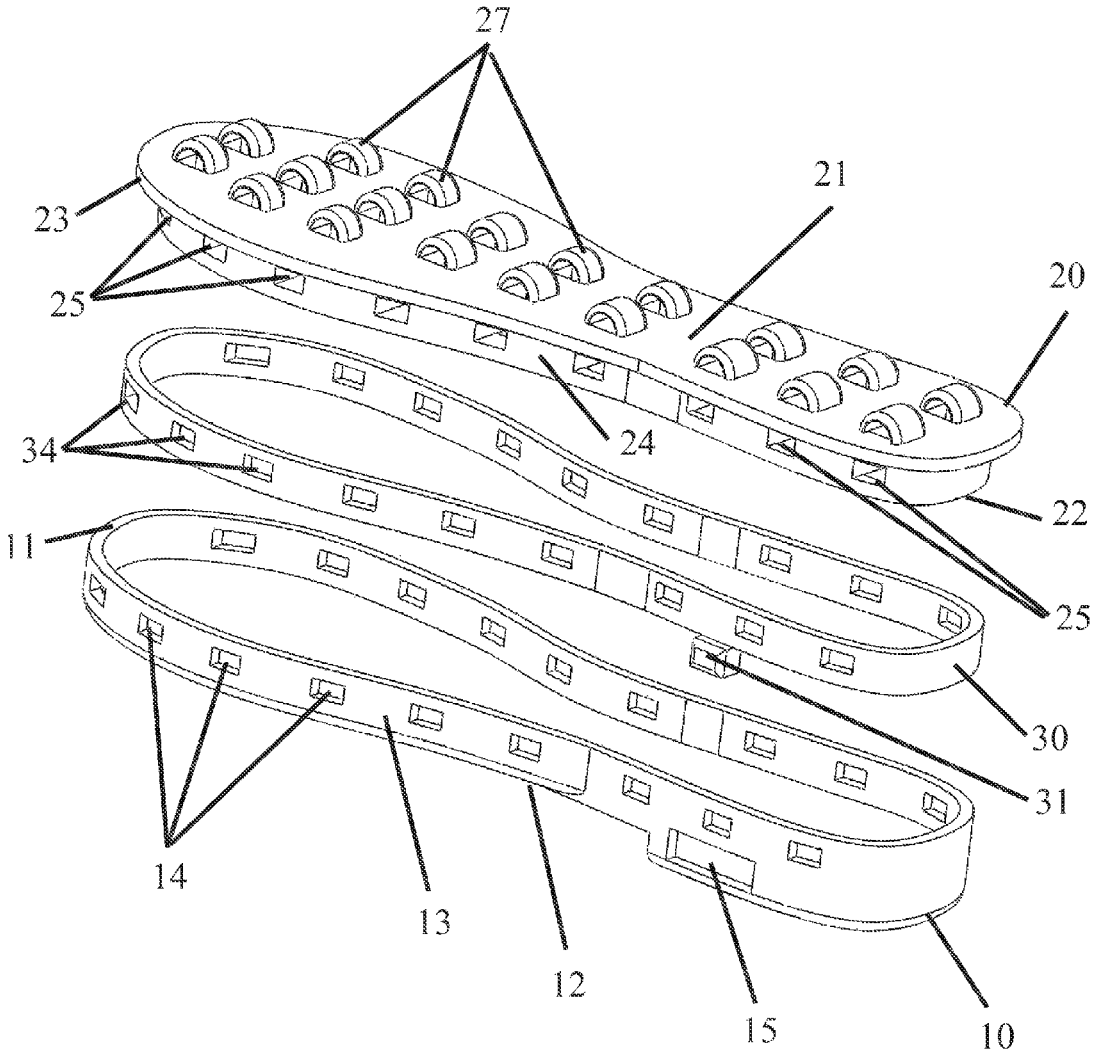
FIG. 5 is an exploded view of the footpad of the present invention.

The present invention comprises a footpad 100 preferably manufactured out of a thermoplastic material such as rubber, polypropylene, or polyethylene. The footpad 100 comprises a bottom pad 10, a top pad 20, and a belt 30, as shown in FIG. 1. The bottom pad 110 has a top face 11, a bottom face 12, and a ridge 13 with multiple ridge holes 14, and a slider cavity 15, as shown in FIG. 2. The top pad 20 has a top face 21, a bottom face 22, a ridge 23, a side face 24, multiple side holes 25, and multiple top holes 26 each covered by a hole protector 27, as shown in FIGS. 3 and 4. The belt 30 has a slider 31 and multiple belt holes 34 that can align with the ridge holes 14, as shown in FIG. 5.

Figure 6:
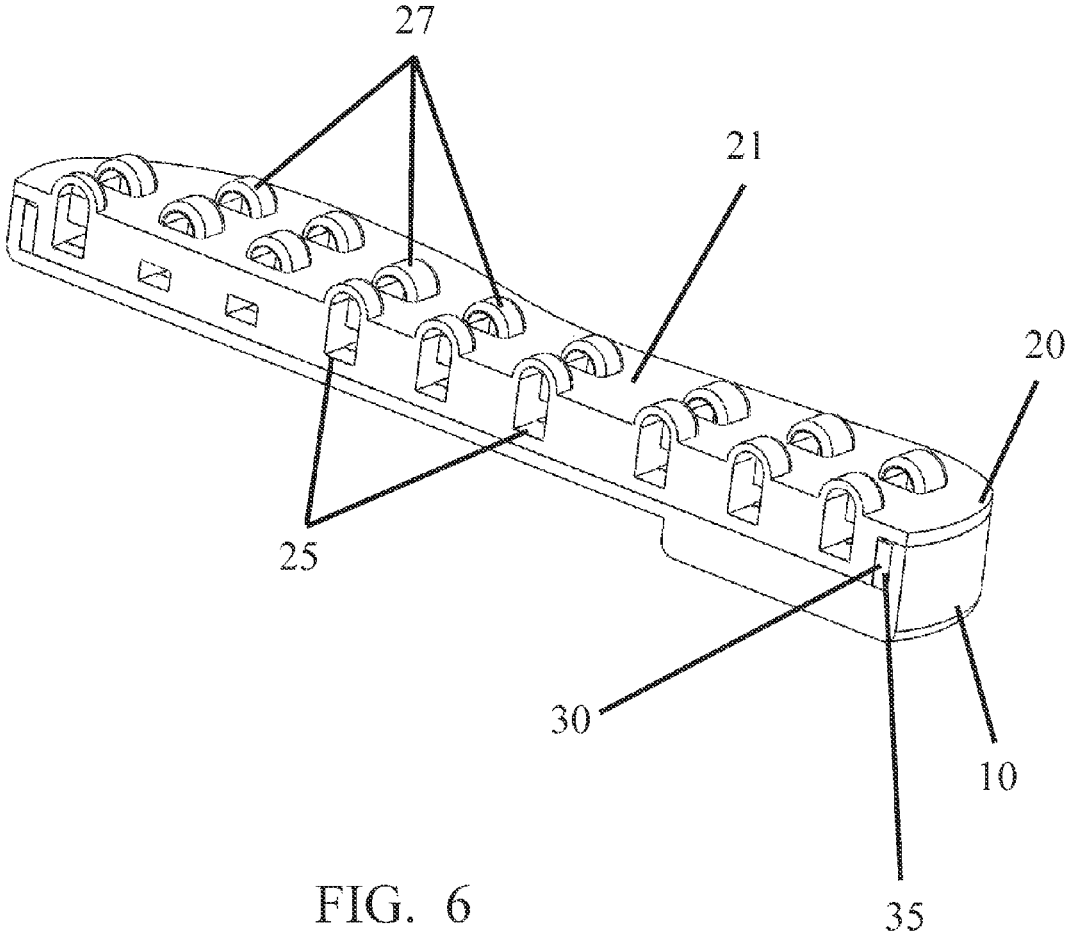
FIG. 6 is a sectional view of the footpad of the present invention to show the belt cavity and the slider cavity.

Assembly of the footpad 100 of the present invention is accomplished by attaching the top pad 20 on to the bottom pad 10, as shown in FIG. 1. The top pad 20 is attached on to the bottom pad 10 such that the ridge 23 of the top pad 20 aligns with the ridge 13 of the bottom pad 10. When the top pad 20 and the bottom pad 10 are aligned, a belt cavity 35 is formed between the ridge 23 of the top pad 20, the ridge 13 of the bottom pad 10, and the side face 24. Therefore, when assembling the top pad 20 to the bottom pad 10, the belt 30 is placed within the belt cavity 35 such that the slider 31 is placed within the slider cavity 15, as shown in FIGS. 1 and 6. Attachment of the top pad 20 to the bottom pad 10 is preferably accomplished with a liquid adhesive. However, other methods can also be used for such attachment, such as, sonic welding, heat staking, pressure fit, and non-liquid adhesive.

Once the top pad 20, the bottom pad 10, and the belt 30 are assembled, the slider 31 can be slid within the slider cavity 15 so as to move the belt holes 34 into and out of alignment with the ridge holes 14. As the slider 31 is moved within the slider cavity 15, the belt 30 is moved within the belt cavity 35.

When the belt holes 34 are in alignment with the ridge holes 14, air from outside the footpad 100 is able to circulate into the footpad 100 through said belt holes 34 and ridge holes 14. Once in the footpad 100, the air accumulates until it circulates out of the footpad 100 through the top holes 26 so as to aerate the foot resting on the footpad 100.

When the belt holes 34 are moved out of alignment with the ridge holes 14, the air from outside the footpad 100 is blocked from circulating into the footpad 100 through said belt holes 34 and ridge holes 14. The belt 30 serves as a block to close the ridge holes 14. Thus, the foot resting on the footpad 100 is not aerated.

Additionally, the thickness and material of the top pad 20 provide support to the foot such that the top pad 20 does not collapse. Furthermore, the hole protectors 27 on the top pad 20 are designed with a dome-like shape and sufficient thickness to provide cushion and support to the foot such that the foot does not block or cover the top holes 26, thus, preventing air from circulating through said top holes 26 to aerate the foot.

Therefore, the use of the footpad 100 of the present invention requires that a foot of the wearer rest against the hole protectors 27 of the top pad 20 while the bottom face 12 of the bottom pad 10 is in contact with the floor or ground. In essence, the footpad 100 of the present invention is used as the sole of a shoe, sandal, or other footwear. As the wearer walks, runs, or jumps, the bottom face 12 provides traction against the floor or ground so that the wearer does not slip or fall. At the same time, the top pad 20 allows the foot of the wearer to rest comfortably and provides cushion support to alleviate the impact upon the joints and vertebrae of the wearer.

More important, as the wearer walks, runs, and/or jumps using the footpad 100 of the present invention, ambient air ventilates the foot by flowing in through the ridge holes 14, through the belt holes 34, and out of the top holes 26 to aerate the wearer's foot. On occasions when the wearer does not wish his foot to be ventilated, such as in cold weather, the slider 31 is used to slide the belt 30 within the belt cavity 35 such that the belt holes 34 are shifted out of alignment with the ridge holes 14. When the belt holes 34 and the ridge holes 14 are out of alignment, air is blocked from entering the footpad 100 to aerate or ventilate the wearer's foot.

It is understood that the described embodiments of the present invention are illustrative only, and that modifications thereof may occur to those skilled in the art. Accordingly, this invention is not to be regarded as limited to the embodiments disclosed, but to be limited only as defined by the appended claims herein.

What is claimed is:

1. A footpad comprising: a top pad having a plurality of side holes that are in communication with a plurality of top holes; a bottom pad having a plurality of ridge holes; a belt having a plurality of belt holes; a belt cavity formed when said top pad is assembled onto said bottom pad; wherein said belt is placed within said belt cavity such that the belt is slidable; wherein air flows into said ridge holes and out of said top holes when said belt is positioned with said belt cavity such that said belt holes are aligned with said ridge holes; and wherein air is restricted from flowing into said ridge holes when said belt is positioned within said belt cavity such that said belt holes are not aligned with said ridge holes, wherein the top pad has a top face, a bottom face, a ridge, a side face, and a plurality of hole protectors, wherein each of the hole protectors protrudes upward from the top face, wherein the plurality of hole protectors are spaced apart from each other; and wherein each hole protector forms a tunnel extending along a width direction of the footpad perpendicular to the length direction of the footpad, such that the tunnel has two opposite ends respectively facing a right side of the footpad and a left side of the footpad.

2. The footpad of claim 1, wherein the plurality of hole protectors are positioned over said top holes.

3. The footpad of claim 1 made of a thermoplastic material.

4. A footpad comprising: a top pad having a plurality of side holes that are in communication with a plurality of top holes; a belt having a plurality of belt holes, said belt placed within a belt cavity; wherein said belt is slidable within said belt cavity; wherein air flows into said ridge holes and out of said top holes when said belt is positioned with said belt cavity such that said belt holes align with said side holes; and wherein air is restricted from flowing into said side holes when said belt is positioned within said belt cavity such that said belt holes do not align with said side holes, wherein the top pad has a top face, a bottom face, a ridge, a side face, and a plurality of hole protectors, wherein each of the hole protectors protrudes upward from the top face, wherein the plurality of hole protectors are spaced apart from each other; and wherein each hole protector forms a tunnel extending along a width direction of the footpad perpendicular to the length direction of the footpad, such that the tunnel has two opposite ends respectively facing a right side of the footpad and a left side of the footpad.

5. The footpad of claim 4, wherein the plurality of hole protectors are positioned over said top holes.

6. The footpad of claim 4 made of a thermoplastic material.

7. A footpad comprising: a top pad having a top face; a plurality of top holes that are in communication with a plurality of side holes; a plurality of hole protectors, wherein each of the hole protectors protrudes upward from the top face and is positioned over a corresponding one of the plurality of top holes; wherein air flows into said side holes and out of said top holes, wherein the plurality of hole protectors are spaced apart from each other; and wherein each hole protector forms a tunnel extending along a width direction of the footpad perpendicular to the length direction of the footpad, such that the tunnel has two opposite ends respectively facing a right side of the footpad and a left side of the footpad.

8. The footpad of claim 7 made of a thermoplastic material.

9. The footpad of claim 7, wherein the top pad further comprises a bottom face that provides traction against a floor surface.

10. The footpad of claim 1, wherein a bottom of the tunnel is directly connected to a corresponding one of the top holes.

11. The footpad of claim 1, wherein each hole protector has an outer peripheral surface having an arch shape.

12. The footpad of claim 4, wherein a bottom of the tunnel is directly connected to a corresponding one of the top holes.

13. The footpad of claim 4, wherein each hole protector has an outer peripheral surface having an arch shape.

14. The footpad of claim 7, wherein a bottom of the tunnel is directly connected to a corresponding one of the top holes.

15. The footpad of claim 7, wherein each hole protector has an outer peripheral surface having an arch shape.

* * * * *